United States Patent [19]

Heinemann et al.

[11] 4,004,740

[45] Jan. 25, 1977

[54] ROLLER CRUSHING MILL

[75] Inventors: Otto Heinemann, Ennigerloh; Heinz-Herbert Schmits, Rheda-Wiedenbruck; Heinz Dieter Baldus, Ahlen, all of Germany

[73] Assignee: Polysius AG, Neubeckum, Germany

[22] Filed: Dec. 31, 1975

[21] Appl. No.: 645,800

[30] Foreign Application Priority Data

Jan. 28, 1975 Germany ..... 7502452[U]

[52] U.S. Cl. ..... 241/52; 241/57; 241/114

[51] Int. Cl.[2] ..... B02C 15/00

[58] Field of Search ..... 241/52, 57, 75, 114, 241/115, 117, 119, 121

[56] References Cited

UNITED STATES PATENTS

| | | | |
|---|---|---|---|
| 1,806,980 | 5/1931 | Kreutzberg | 241/115 |
| 2,698,142 | 12/1954 | Criter et al. | 241/121 |
| 3,465,971 | 9/1969 | Dalenberg et al. | 241/119 |

*Primary Examiner*—Granville Y. Custer, Jr.

[57] ABSTRACT

A roller crushing mill has a housing within which is a plurality of angularly spaced crushing rollers that bear on a grinding plate rotatable about a vertical axis. Above each roller is a sifter for the reception of crushed material. Nozzles positioned in the vicinity of the rollers establish upwardly directed airstreams at the periphery of the grinding plate to entrain crushed material thrown off the grinding plate and deliver such crushed material to the sifters. Other nozzles positioned between adjacent ones of the rollers at the periphery of the grinding plate direct airstreams inwardly of the plate toward the crushing track to feed material to the crushing track.

7 Claims, 5 Drawing Figures

ROLLER CRUSHING MILL

This invention relates to a roller crushing mill having a grinding plate rotatable about its vertical axis, a number of crushing rollers or pairs of crushing rollers disposed at uniform peripheral distances on the crushing plate and rotating about generally horizontal axes, an air supply conduit disposed below the plane of the crushing plate, and means above the grinding plate for sifting the air charged with crushed material.

If roller mills of the above type are constructed for high outputs, the height of the structure is undesirably great, and there is considerable loss of pressure, since the sifting air charged with crushed material and supplied below the plane of the crushing plate has to be deflected repeatedly before it enters the sifter. With the air supply system in known roller mills, the rising air stream also frequently entrains material which has not yet passed the crushing rollers. Known roller crushing mills, especially the higher output types, thus also involve the disadvantage of a relatively poor sifting efficiency and inadequate controllability.

This invention has for its objective the provision of a roller crushing mill constructed in such manner that the disadvantages referred to above are avoided.

According to the invention this objective is achieved in that the sifter means comprises a number of sifters corresponding to the individual crushing rollers or pairs of crushing rollers and disposed adjacent each other in like peripheral spacing, and in that air nozzles for substantially upwardly directed air streams are provided on the perimeter of the grinding plate in the area of the individual crushing rollers or pairs of crushing rollers, while in the areas between the individual crushing rollers or pairs of crushing rollers there are provided air nozzles for throttled airstreams directed inwardly toward the crushing track.

In accordance with the invention there are provided as many individual sifters as there are crushing rollers or pairs of crushing rollers, so that each crushing unit is associated with a separate sifter disposed relatively close above it. Accordingly, there is obtained a notable reduction in the total height of the entire roller crushing mill (in conjunction with a lesser weight for the machine, a smaller total volume and the possibility of making larger production units). Because of the lesser height the crushed material must be conveyed, and because of the largely deflection-free feed of the sifting air, there is also a considerable reduction in pressure losses and an improvement in the overall sifting efficiency.

One particularly favorable feature of the invention is that firstly the sifting air, in the vicinity of the individual crushing rollers or pairs of crushing rollers, flows in a substantially upward directed stream, largely free of deflection, and hence directly entrains the major portion of the material reduced by the crushing rollers, while secondly, in the area between the individual rollers or pairs of rollers, the throttled airstream is directed toward the crushing track, so that material which has not yet passed the crushing rollers is fed toward the crushing track. This thus prevents any large proportion of insufficiently reduced material being upwardly entrained in the airstreams rising toward the sifters.

A roller crushing mill constructed in accordance with the invention may, for example, be fitted with three crushing rollers or pairs of crushing rollers disposed at 120° intervals around the perimeter, together with three sifters disposed above these crushing rollers or pairs of crushing rollers.

A variation of the invention provides four crushing rollers or pairs of crushing rollers disposed at approximately 90° intervals around the perimeter with four superimposed sifters. Within the scope of the invention it is also obviously possible to have roller crushing mills with differing numbers of pairs of rollers and sifters.

The sifters may comprise static or dynamic sifters. A great variety of constructions are also conceivable within the scope of the invention for the support of the crushing rollers or pairs of crushing rollers.

Two embodiments of the invention are shown in the drawings, in which.

Figure 1:
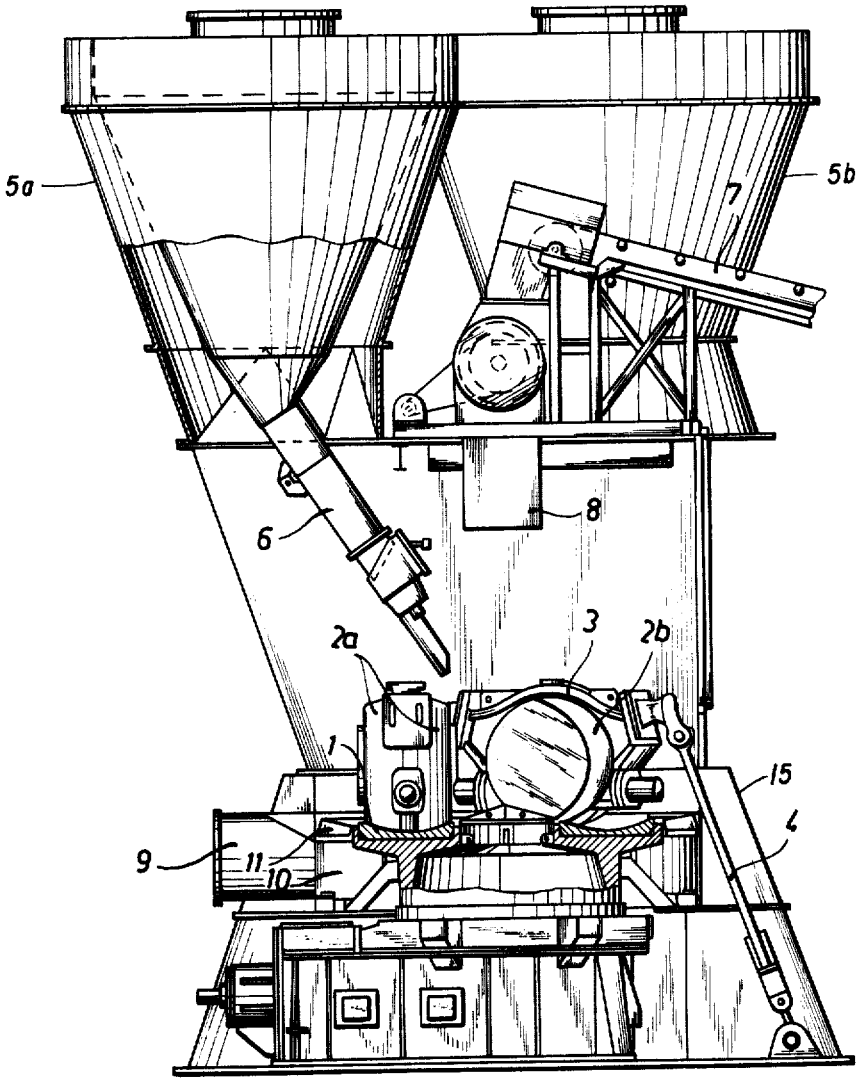
FIG. 1 is a vertical section through a roller crushing mill constructed in accordance with one embodiment of the invention.
Figure 2:
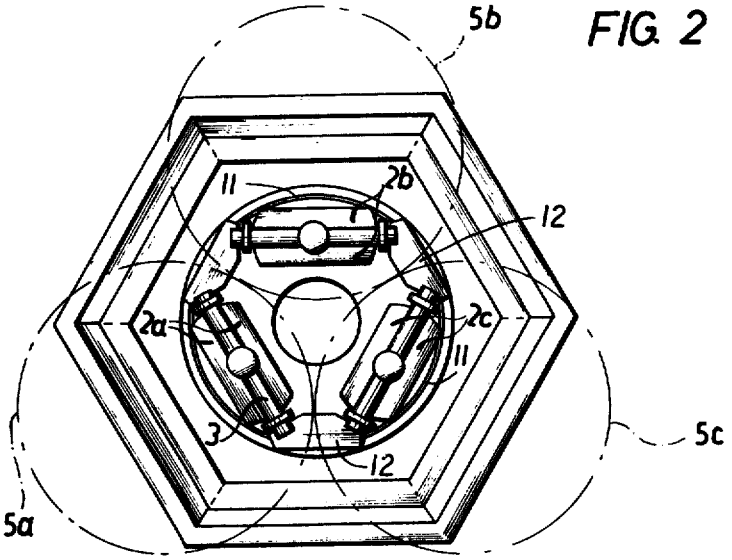
FIG. 2 is a horizontal section through the roller crushing mill in FIG. 1 (at the level of the crushing roller axes)

The roller crushing mill shown in FIGS. 1 and 2 includes an outer housing 15 within which is a circular grinding plate 1 rotatable on its vertical axis in a conventional manner, the driving mechanism not being shown in detail. Three pairs of crushing rollers 2*a*, 2*b* and 2*c* bear on the grinding plate 1 at uniform perimetral spacings of approximately 120°. These crushing rollers are conventionally mounted for rotation about substantially horizontal axes and are supported by frames 3 and tension bars 4 in manner not of present consequence. The crushing force can be produced in known manner by hydraulic cylinders, with the interposition of resilient and damping members.

In the embodiment shown in FIGS. 1 and 2, three sifters 5*a*, 5*b*, 5*c* are supported by the housing 15 above the three pairs of crushing rollers 2*a*, 2*b* and 2*c*. These sifters are disposed in sequence at the same perimetral spacing as the pairs of crushing rollers, i.e., at approximately 20° intervals. Each sifter has a coarse material outlet pipe 6 for returning to the central area of the grinding plate 1 any material insufficiently reduced.

The material for grinding is supplied via feed means 7 which leads to a chute 8 in the housing and from which material is discharged to the central area of the grinding plate 1.

Figure 4:
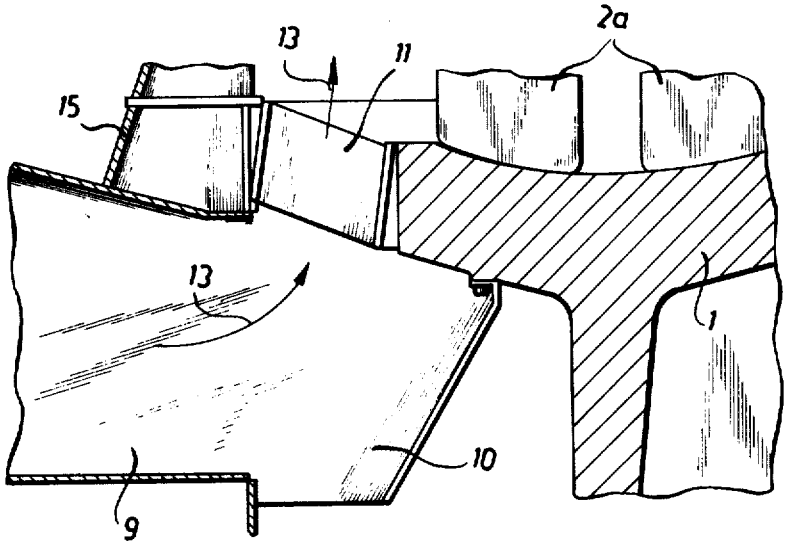
FIGS. 4 and 5 are partial sections, on an enlarged scale, through the area of the roller crushing mill which includes the air supply nozzles.
Figure 5:
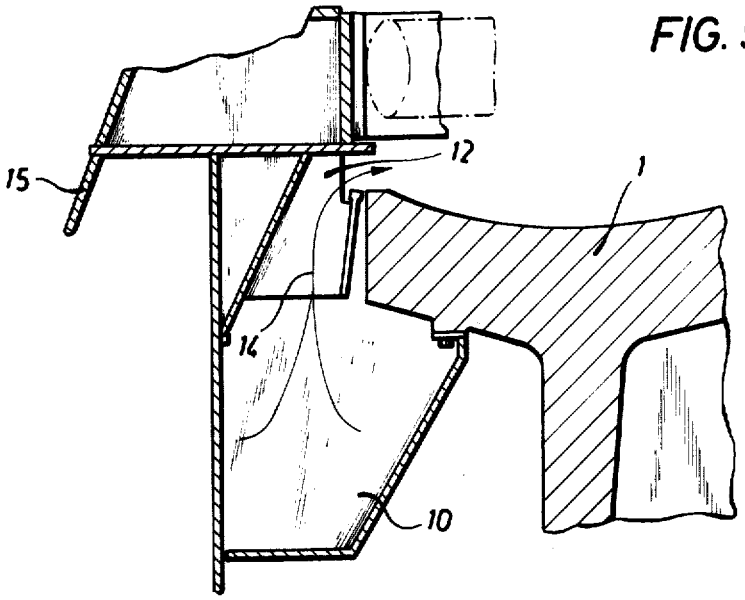

As is best shown in FIGS. 4 and 5, sifting air is supplied via a pipe 9 and an annular conduit 10 provided below the plane of the grinding plate and from which the air can emerge through nozzles 11 and 12 into the housing. The nozzles 11 are at the perimeter of the grinding plate 1 in the vicinity of the individual pairs of crushing rollers, e.g. 2*a*, and permit a generally unthrottled and upwardly directed airstream (arrow 13) whereby the pulverized material thrown off the plate 1 is directly fed, largely without any reversal of direction, to the sifter disposed above the pair of crushing rollers concerned.

The nozzles 12 are in contrast disposed at the perimeter of the grinding plate 1 in the area between the individual pairs of crushing rollers, and are configured and sized to permit only a throttled flow of air (arrow 14) which in general is first directed radially inward of and onto the crushing plate before it passes into the associated sifter. This ensures that material located between the pairs of crushing rollers and not yet sufficiently reduced in size is first fed again into the crushing track before it is later, after appropriate reduction, taken up to the sifters by the rising airstream (arrow 13).

The nozzles 11 and 12 are disposed in sector form at the lower part of the housing 15 of the roller crushing mill.

Figure 3:
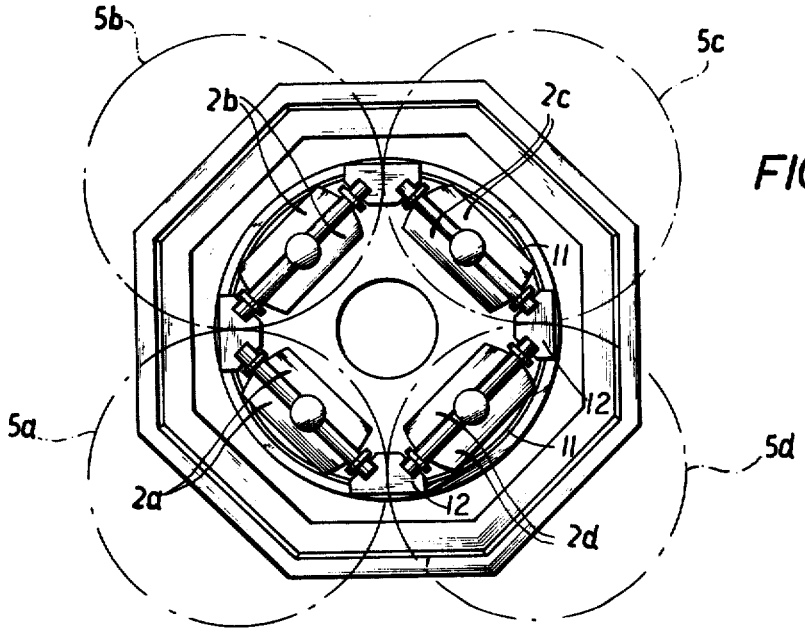
FIG. 3 is a section, similar to FIG. 2, through a second embodiment of the invention.

In the embodiment shown in FIG. 3, four pairs of crushing rollers 2*a*, 2*b*, 2*c* and 2*d* are provided at perimetral intervals of some 90°, each pair being associated with one of the sifters 5*a*, 5*b*, 5*c* and 5*d* disposed above them at the same 90° perimetral intervals. The air supply embodiment of FIG. 3 corresponds to that explained by means of FIGS. 4 and 5.

The disclosed embodiments are representative of presently preferred forms of the invention, but are intended to be illustrative rather than definitive thereof. The invention is defined in the claims.

We claim:

1. In a crushing mill having a housing, a grinding plate within said housing rotatable about a substantially vertical axis, a plurality of roller means at peripherally spaced intervals bearing on said grinding plate and rotatable about a substantially horizontal axis, sifting means supported above said grinding plate in communication with said housing for receiving and sifting crushed material, and air conduit means below said grinding plate for supplying sifting air, the improvement comprising first nozzle means between said conduit means and said housing adjacent the periphery of said plate and positioned in the vicinity of each of said roller means for establishing a substantially upwardly directed first airstream, and second nozzle means between said conduit means and said housing adjacent the periphery of said plate and positioned between adjacent ones of said roller means for establishing second airstreams directed inwardly of said plate.

2. The construction according to claim 1 wherein there are three of said roller means spaced substantially 120° apart.

3. The construction according to claim 1 wherein there are four of said roller means spaced substantially 90° apart.

4. The construction according to claim 1 including a plurality of said sifting means corresponding to the number of said roller means.

5. The construction according to claim 1 wherein each of said roller means comprises an individual roller.

6. The construction according to claim 1 wherein each of said roller means comprises a pair of rollers.

7. The construction according to claim 1 wherein said second nozzle means is constructed to exert a throttling effect on said second airstream.

* * * * *

UNITED STATES PATENT AND TRADEMARK OFFICE

CERTIFICATE OF CORRECTION

PATENT NO. : 4,004,740

DATED : January 25, 1977

INVENTOR(S) : Otto Heinemann et al

It is certified that error appears in the above-identified patent and that said Letters Patent are hereby corrected as shown below:

Column 2, line 44, change "20°" to --120°--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*